US007723595B2

(12) United States Patent
Dunlop

(10) Patent No.: US 7,723,595 B2
(45) **Date of Patent: *May 25, 2010**

(54) UNIVERSAL, PORTABLE SHEET READING STAND

(76) Inventor: Jim Dunlop, 1721 Rockville Rd., Fairfield, CA (US) 94534

( * ) Notice: Subject to any disclaimer, the term of this patent is extended or adjusted under 35 U.S.C. 154(b) by 79 days.

This patent is subject to a terminal disclaimer.

(21) Appl. No.: 11/674,104

(22) Filed: Feb. 12, 2007

(65) Prior Publication Data

US 2008/0190265 A1 Aug. 14, 2008

(51) Int. Cl.
*G10D 13/02* (2006.01)

(52) U.S. Cl. ..... 84/421; 248/443

(58) Field of Classification Search ..... 84/421, 84/187, 188; 248/181, 205.8, 288.31, 443
See application file for complete search history.

(56) References Cited

U.S. PATENT DOCUMENTS 3,948,476 A * 4/1976 Kuniyosi ..... 248/443
5,845,885 A * 12/1998 Carnevali ..... 248/181.1
6,459,023 B1 10/2002 Chandler
6,666,420 B1 * 12/2003 Carnevali ..... 248/205.8
2006/0086872 A1 4/2006 Fan
2008/0061197 A1 * 3/2008 Carnevali ..... 248/181.1

* cited by examiner

*Primary Examiner*—Jianchun Qin
(74) *Attorney, Agent, or Firm*—West & Associates, A PC; Stuart J. West; Charlotte Rodeen-Dickert

(57) ABSTRACT

A sheet music holder having a golpe board with a non-porous surface for gluing into a guitar body with a porous surface, a twist lock power-assisted suction device, a clamp with a single tightening nut, and a sheet tray to hold the sheet music. The twist lock power-assisted suction device allows a user to easily create a strong vacuum attachment that will last fro hours so a complete performance will not be interrupted. The golpe board is included where the guitar body has a porous surface that would otherwise frustrate the suction attachment. The double-ball-and-socket clamp and arm allows a variety of positioning possibilities for the user to best read the sheet music in the tray.

17 Claims, 4 Drawing Sheets

UNIVERSAL, PORTABLE SHEET READING STAND

BACKGROUND

1. Field of the Invention

The present invention relates to musical instruments and in particular to methods, systems, and devices for holding sheet music on an instrument where an artist can read it during a musical performance.

2. Related Art

Sheet music is rather awkward to hold and read while trying to play a musical instrument like a guitar. But being able to read the music while playing the instrument is a critical necessity. Sheet music stands are very familiar to most people, but such take up floor space, are top heavy, easily knocked over, and restrict the movements of the performer.

Attempts have been made to attach holders to guitars before, but the kind that clamp-on are heavy and can mar the instrument, and other devices that use suction cups don't really attach in a satisfactory fashion or remain in place for an acceptable period of time. Often the surfaces of the guitar are a little porous, and defeat any suction device applied. Other suction devices are cheap and flimsy, and just don't apply a high enough vacuum to really keep the attachment firmly in place. See, for example, U.S. Pat. No. 3,948,476 to Shiniti Kunyosi.

SUMMARY OF THE INVENTION

Briefly, a sheet music holder embodiment of the present invention comprises a golpe board of non-porous material for gluing onto a guitar body should the surface be porous, a twist lock suction device that is power-assisted for maximum consistent suction, a clamp with a single tightening nut, and a sheet tray to hold the sheet music. The twist lock power-assisted suction device allows a user to easily create a strong vacuum attachment that will last for hours.

The non-porous golpe board is included where the guitar body has a porous surface that would otherwise frustrate the suction attachment. In some embodiments, a substantially non-porous or non-porous mounting board, which is not attached to the instrument, can be included, such that the suction mechanism and associated sheet music tray can be selectively coupled with the mounting board and the mounting board can be located in any convenient location. The double-ball and socket clamp and arm allows a variety of positioning possibilities for the user to best read the sheet music in the tray.

An advantage of the present invention is that a sheet music holder is provided that is easy to use.

Another advantage of the present invention is that a sheet music holder is provided that will not mar a musical instrument even after repeated uses.

A further advantage of the present invention is that a sheet music holder is provided that will stay fastened for many hours and not slip off accidentally thanks to a twist-lock action in the power-assisted suction device.

These and other objects and advantages of the present invention will no doubt become obvious to those of ordinary skill in the art after having read the following detailed description of the preferred embodiments which are illustrated in the various drawing figures.

DETAILED DESCRIPTION

Figure 1:
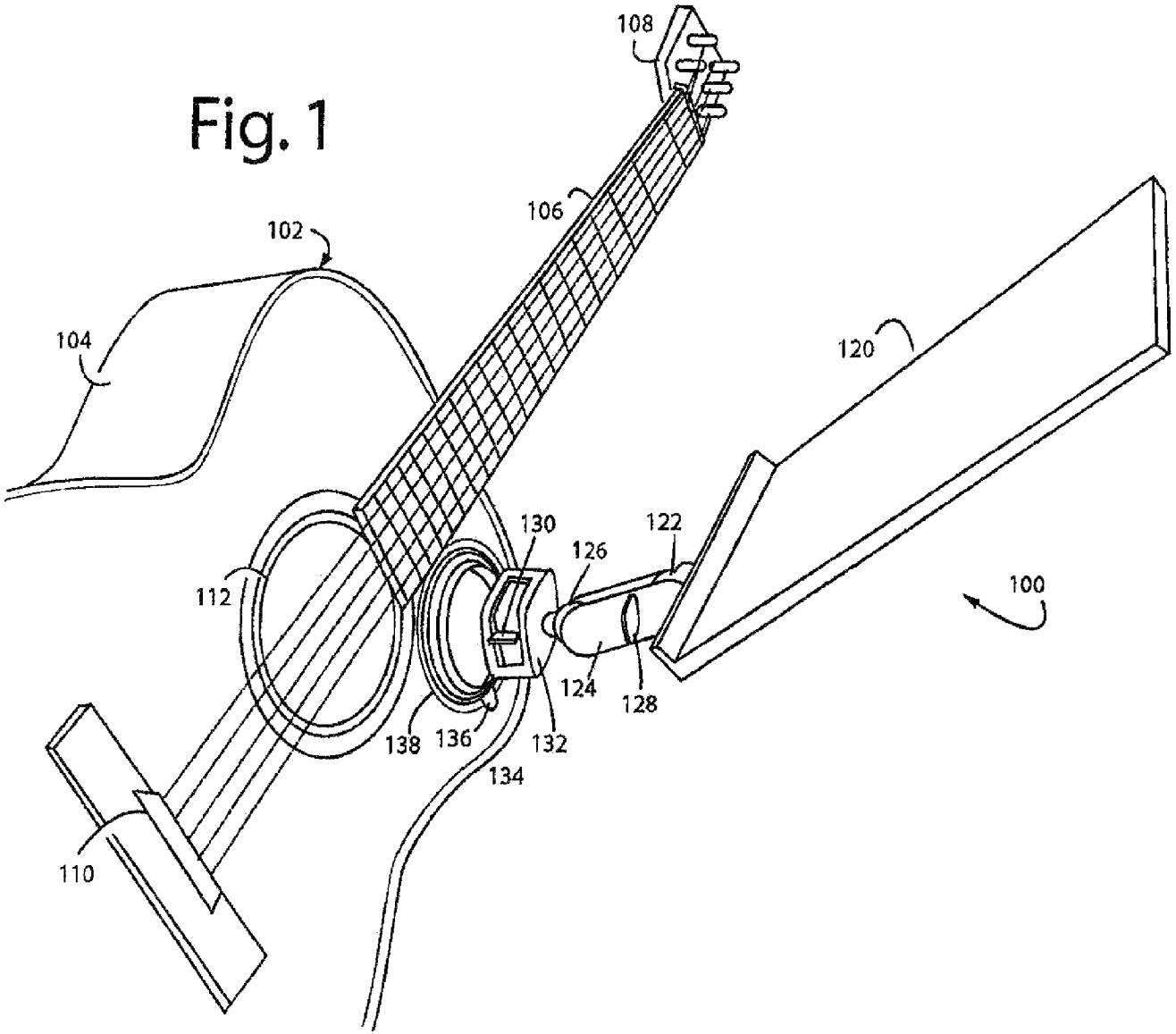
FIG. 1 is a perspective diagram of a sheet music holder embodiment of the present invention that is attached, as an example, to an acoustic guitar.

FIG. 1 represents a sheet music holder embodiment of the present invention, and is referred to herein by the general reference numeral 100. The sheet music holder 100 attaches, for example, to an acoustic guitar 102 comprising a body 104, a fret board 106, a key head 108, a bridge 110, and a sounding hole 112. While FIG. 1 depicts use of the sheet music holder 100 being used in connection with an acoustic guitar 102, in alternate embodiments, the sheet music holder 100 can be used in connection with any item, instrumental or otherwise.

In the embodiment shown in FIG. 1, the sheet music holder 100 itself comprises a sheet holding tray 120 with a tray clamp ball 122 joined by a clamp assembly 124 to a base clamp ball 126 and tightened with a handle 128. In the embodiment shown in FIG. 1, a power-assisted suction base can be comprised of an activation lever 130 inside a base housing 132 that draws the base tight onto the guitar 102. In some embodiments, the suction base can include a release tab 134 allows a quick release of suction cup 136 from a non-porous or substantially non-porous surface.

In some embodiments, a substantially non-porous or a non-porous surfaced golpe board 138 can be used if the instrument itself has a porous surface. In the embodiment depicted in FIG. 1, the clamp assembly 124 allows a user to position the sheet holding tray 120 in substantially any convenient position relative to the instrument and/or golpe board 138 and or mounting surface. In operation, the tray clamp ball 122 and base clamp ball 126 can be loosely coupled with the clamp assembly 124, the sheet holding tray 120 can be positioned as desired, and then the clamp can be fully tightened to fix geometric relation between the mounting surface and the sheet holding tray 120.

In some embodiments, the golpe board 138 can be attached to the body 104, e.g., with adhesive or via any other known and/or convenient apparatus, mechanism or compound, and provides a high quality, non-porous or substantially non-porous surface for vacuum cup attachment. Traditionally, golpe boards are attached to guitars for flamenco music performances where the guitar body is subject to heavy tapping that could damage the soft wood and finishes. If the guitar body 104 already has a suitable surface, the golpe board 138 may not be needed and can be omitted. In alternate embodiments, the golpe board 138 can be comprised of any known and/or convenient material and can have any known and/or convenient shape and can be attached to any convenient manner to the body. In still further alternate embodiments, the golpe board 138 may not be a traditional golpe board, but can be comprised of any known and/or convenient material and can have any known and/or convenient shape and can be attached to any convenient manner to any surface of any item, instrument and/or object.

In some embodiments, the suction base and clamp assembly may be a National Products, Inc., type RAM 101-2241U, RAM-MOUNT with twist lock cup. The twist lock power-assisted suction device is described by Jeffrey Carnevali in U.S. Pat. No. 6,666,420, issued Dec. 23, 2003, the complete contents of which is incorporated herein by reference. However, in alternate embodiments, any known and/or convenient non-power-assisted and/or power-assisted suction mechanism can be used.

Figure 2:
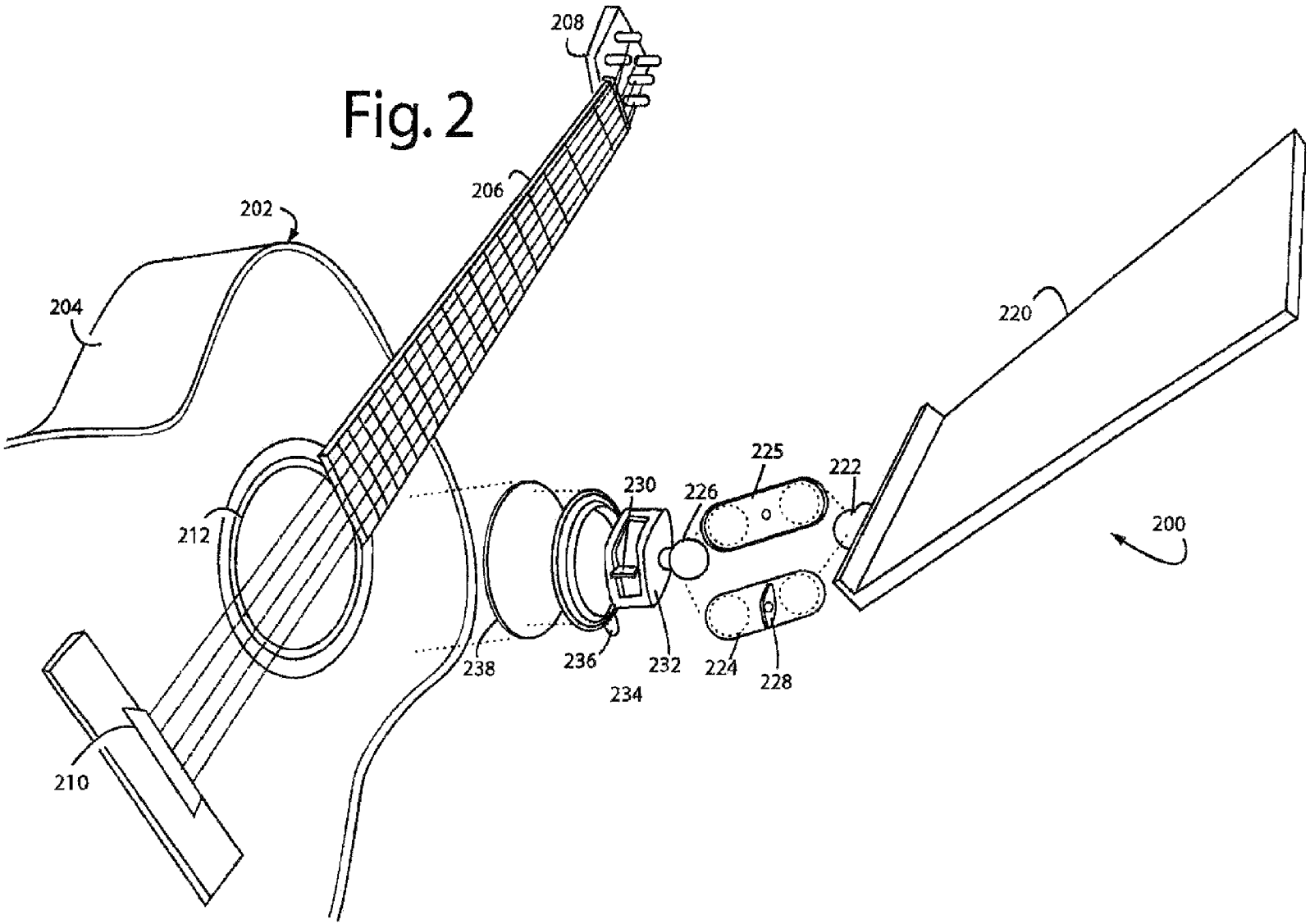
FIG. 2 is an exploded assembly diagram of the sheet music holder of FIG. 1 showing how the pieces come together and attach to the acoustic guitar.

FIG. 2 represents a sheet music holder assembly, and is referred to herein by the general reference numeral 200. The sheet music holder 200 can attach to a musical instrument or nearby surface. If the musical instrument or nearby surface is an acoustic guitar 202, such can comprise a body 204, a fret board 206, a key head 208, a bridge 210, and a sounding hole 212. In some embodiments, the sheet music holder 200 itself can comprise a sheet holding tray 220 coupled with a tray clamp ball 222. In operation, a pair of clamp shells 224 and 225, with ball sockets, can capture tray clamp ball 222 and a similar base clamp ball 226. They can then be simultaneously tightened around both balls 222 and 226 with a single T-handle tightening nut 228 on a bolt and/or via any other known and/or convenient mechanism. A suction base has an activation lever 230 inside a base housing 232 that draws the base tight onto a non-porous and/or substantially non-porous surface. In some embodiments, a release tab 234 allows a quick release of suction cup 236, e.g., against a golpe board 238 that was coupled with the guitar body 204. The clamp assembly 224 allows a user to position the sheet holding tray 220 relative to the instruction or nearby surface in any known and/or convenient geometric relation.

Figure 3:
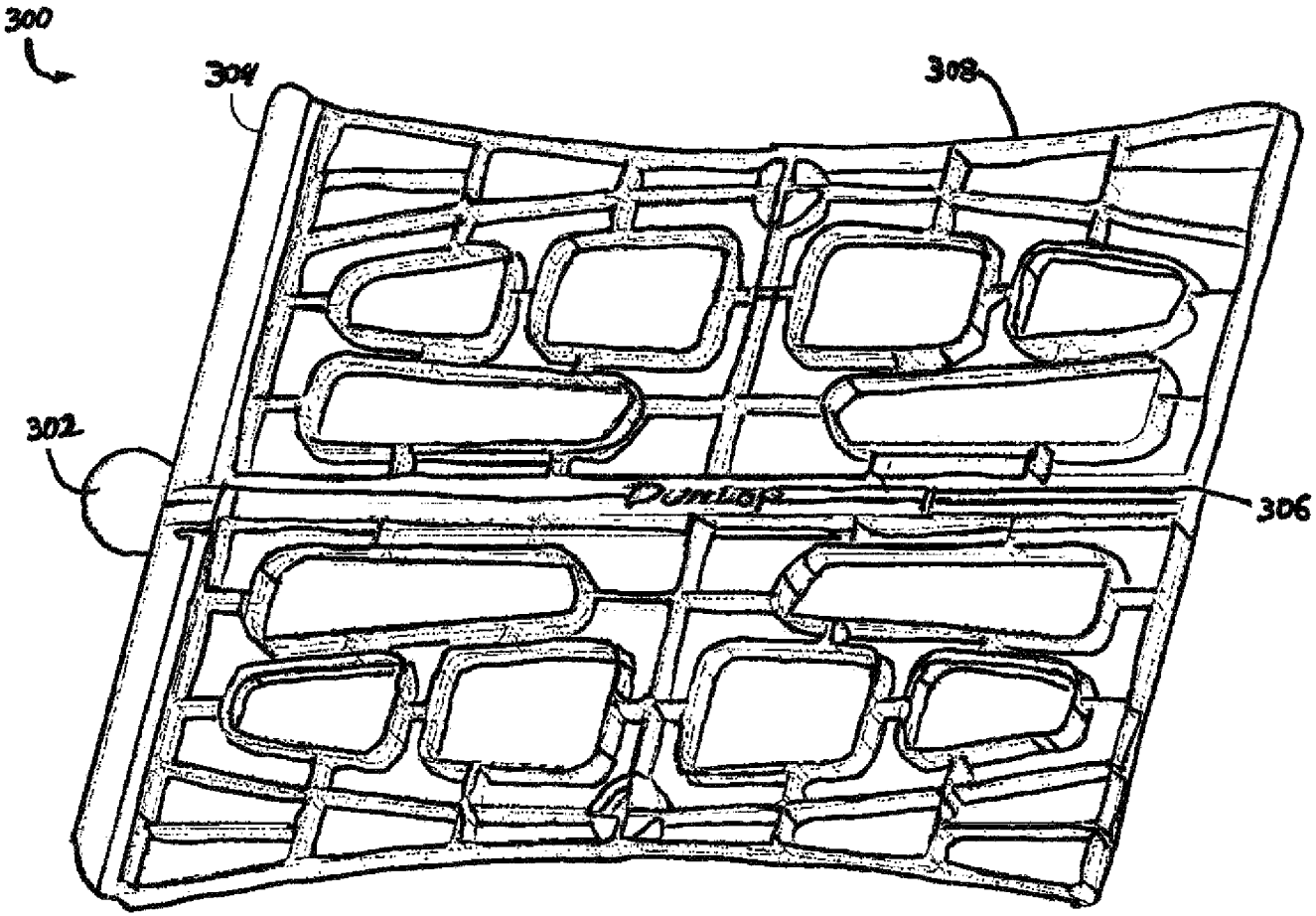
FIG. 3 is a perspective view diagram of a decorative 10 type of sheet music tray that could be included in the holders illustrated in FIGS. 1 and 2.

FIG. 3 shows a music sheet tray 300 with a particular 25 decorative design that provides maximum surface area and strength with a minimum of weight. Of course, other designs could be used. The tray 300 comprises a tray clamp ball 302 to fit into a clamp as shown in FIGS. 1 and 2. A lip 304 provides a bottom support for sheets of paper, e.g., sheet music. The tray clamp ball 302 and base clamp ball are preferably about the same size diameter. A back 308 would be visible to an audience, and a backbone 306 provides added strength such as would be needed in a plastic injection molded implementation.

Figure 4A:
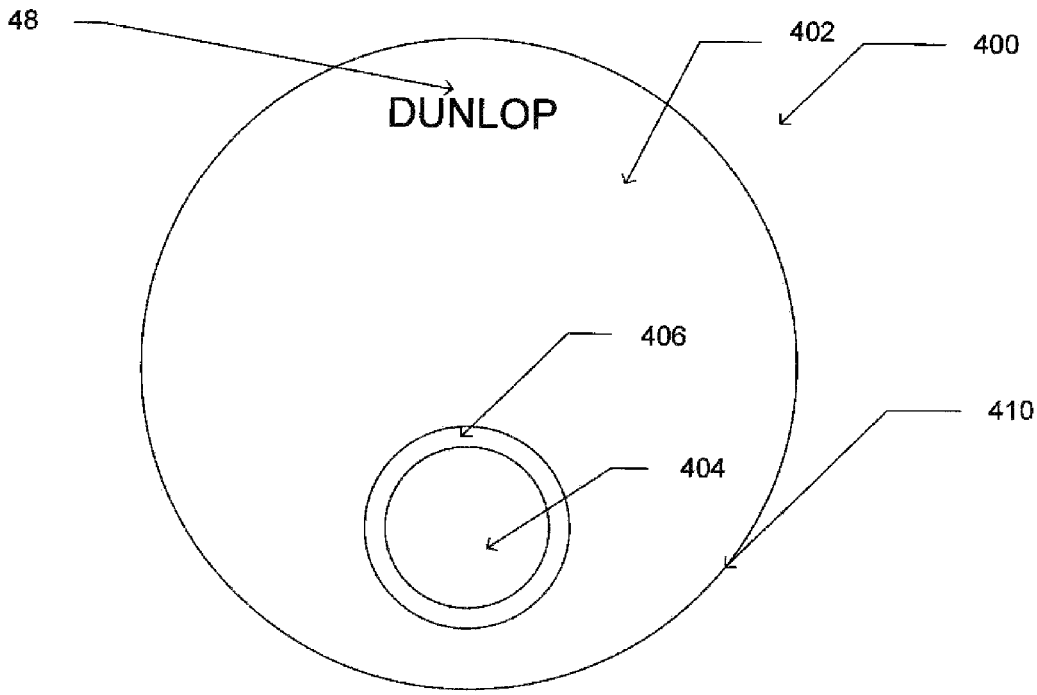
FIG. 4*a* depicts a plan view of a mounting board that can be selectively coupled with the sheet music tray via a suction mechanism.

FIG. 4*a* depicts a mounting board 400 that can be used in conjunction with the sheet music holder 100. In the embodiment shown in FIG. 4*a*, the mounting board 400 is comprised of a first region 402 and a second region 404 and a transition region 406. In the embodiment shown in FIG. 4*a*, the first region 402 can have any known and/or convenient texture and/or porosity and/or image and/or geometric properties. In some embodiments, the first region can be substantially planar and can be comprised of a substantially non-porous material. However, in alternate embodiments, the first region can have a non-uniform surface. In still further alternate embodiments, the first region 402 can include any convenient decoration and/or image 408.

In the embodiment shown in FIG. 4*a*, the second region can be substantially planar and can be comprised of a substantially non-porous material and/or any material capable of substantially maintaining a vacuum bond with the suction cup of the sheet music holder 100. In some embodiments, the first region 402 and second region 404 can be comprised of the same and/or similar material and can be of unitary construction. However, in alternate embodiments, the first region 402 and the second region 404 can be comprised of different materials and can be coupled with each other.

In the embodiment shown in FIG. 4*a*, the mounting board 400 can include a transition region 406. In the embodiment shown in FIG. 4*a*, the transition region can server to, at least partially, separate the first region 402 and the second region 404. In some embodiments, the first region 402, second region 404 and the transition region 406 can be comprised of the same material and can be of unitary construction. In alternate embodiments, the transition region 406 can be comprised of any known and/or convenient material and/or can be comprised of the same material as the first region 402 and/or the second region 404. In some embodiments, the transition region 406 can bear any known and or convenient geometric relation to the first region 402 and the second region 404.

In some embodiments, the underside 410 of the mounting board 400 can have any known and/or convenient geometry properties. In some embodiments, the underside 410 of the mounting board 400 can include a temporary bonding material such that the underside 410 of the mounting board 400 can be selectively coupled with any known and/or convenient surface and/or material. In some embodiments, the underside 410 of the mounting board 410 can include a surface that has a substantially high coefficient of static and/or kinetic friction relative to any selected material.

Figure 4B:
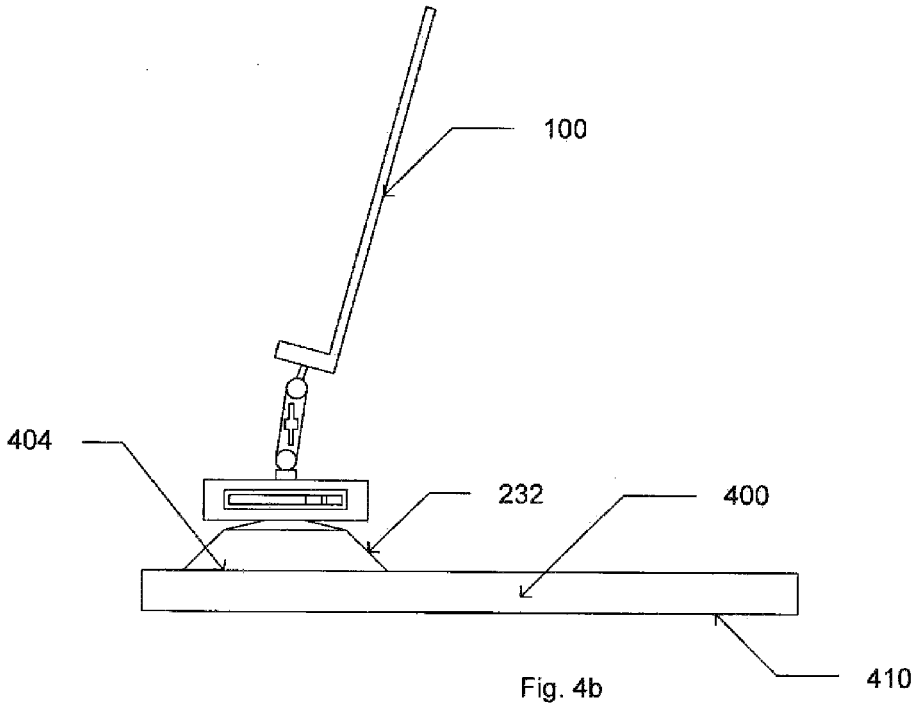
FIG. 4*b* depicts an elevation view of the sheet music tray coupled with the mounting board via the suction mechanism.

FIG. 4*b* depicts an embodiment of the mounting board 400 depicted in FIG. 4*a* in use with the sheet music holder 100. In the embodiment shown in FIG. 4*b*, the mounting board 400 is substantially planar and the sheet music holder 100 is selectively coupled with the second region 404 of the mounting board 400 via the suction base. In some embodiments, the mounting board 400 can have any known and/or convenient geometric and/or inertial and/or section modulus properties such that when the mounting board 400 and the sheet music holder 100 are coupled that the combination is statically and/or dynamically stable.

In some embodiments, in operation, the sheet music holder 100 can be used with or without the mounting board 400 and can, in some embodiments, be used by a computer operator or typist to support paper, documents, books and/or other items.

In some embodiments, in operation, the sheet music holder 100 can be used with or without the mounting board 400 and can, in some embodiments, be used by a chef and/or to support recipes, paper, documents, books and/or other items.

In some embodiments, in operation, the sheet music holder 100 can be used with or without the mounting board 400 and can be supported on any convenient surface, such as, over a table cloth, on a couch, on a floor and/or any other surface capable of supporting the base and/or capable of being attached by the suction mechanism.

In some embodiments, in some embodiments, the sheet music holder 100 can be removably mounted, via the suction mechanism, directly on an instrument, such as, a guitar, bass, ukulele, keyboard and/or any other instrument having a non-porous and/or substantially non-porous surface. In alternate embodiments, the sheet music holder 100 can be removably mounted, via the suction mechanism, directly on an instrument, such as, a guitar, bass, ukulele, keyboard and/or any other instrument which has been coupled and/or removably coupled with a non-porous and/or substantially non-porous surface.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the "true" spirit and scope of the invention.

What is claimed is:

1. A holder, comprising:

a mounting board;

a power-assisted suction device for selectively coupling with said mounting board;

a base clamp ball attached to the power-assisted suction device;

a device to display readable musical notation during a performance of a musical instrument;

a clamp ball attached to the display device; and a clamp;

wherein the clamp captures the base ball and display device clamp balls and allows adjustment of the tilt and angle of the display device relative to the item.

2. The holder of claim 1, wherein said mounting board is comprised of a material selected from the group consisting of a substantially non-porous material and a non-porous material.

3. The holder of claim 2, wherein said mounting board is adapted and configured such that positioning said display device relative to said mounting board in substantially any configuration will not result in overturning of said holder.

4. The holder of claim 2, wherein said first surface of said mounting board is attached to an exterior surface of a musical instrument and said second surface of said mounting board providing a substantially non-porous surface for temporary attachment of said power-assisted suction device to the musical instrument without marring.

5. The holder of claim 4, wherein the musical instrument is an acoustic guitar.

6. The holder of claim 5, wherein the mounting board is affixed near the fret board of the guitar body.

7. The holder of claim 1, wherein said mounting board is adapted and configured such that positioning said display device relative to said mounting board in substantially any configuration will not result in overturning of said holder.

8. The holder of claim 1, wherein said mounting board is adapted and configured such that the center of mass of said holder, in any configuration, lies within the kernel of the holder.

9. The sheet music holder of claim 1, further comprising: a lever-lock included in the suction device for increasing the holding power and thereby increase the time of temporary attachment into a range of hours.

10. The holder of claim 1, wherein the display device clamp ball is located near the center of the display device at the bottom.

11. The holder of claim 1, wherein the base clamp ball is located at the top of the suction device.

12. A kit comprising:

a mounting board;

a display device;

a power-assisted suction device for selectively coupling with at least one of said mounting board and an item having at least a substantially non-porous surface.; and a clamping device for selectively coupling said display device and said power-assisted suction device in any convenient geometric configuration.

13. The kit of claim 12, wherein said mounting board is comprised of a material selected from the group consisting of a substantially non-porous material and a non-porous material.

14. The kit of claim 12, wherein said mounting board includes at least one surface having an adhesive.

15. The kit of claim 12, wherein said mounting board is configured such that in substantially any configuration, the center of mass of said mounting board, said display device, said power-assisted suction device and said clamping device lies within the kernel of the configuration.

16. The kit of claim 15, wherein said mounting board includes at least one surface having a coefficient of static friction greater than 0.5 relative to a selected material.

17. A holder, comprising:

a power-assisted suction device for selectively coupling with a mounting board;

a base clamp ball attached to the power-assisted suction device;

a display device for holding sheets of music for a musician to read during a performance of said musical instrument;

display device clamp ball attached to the tray; and a clamp;

wherein the clamp captures the base ball and display device clamp balls and allows adjustment of the tilt and angle of the display device relative to the mounting board.

* * * * *